US007036348B2

(12) United States Patent
McClung

(10) Patent No.: US 7,036,348 B2
(45) Date of Patent: May 2, 2006

(54) METHOD AND APPARATUS FOR FORMING CONTAINER END SHELLS WITH REINFORCING RIB

(75) Inventor: James A. McClung, N. Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 384 days.

(21) Appl. No.: 10/648,981

(22) Filed: Aug. 26, 2003

(65) Prior Publication Data

US 2005/0044920 A1 Mar. 3, 2005

(51) Int. Cl.
*B21D 51/44* (2006.01)

(52) U.S. Cl. ..... 72/348; 72/379.4; 72/336; 413/8

(58) Field of Classification Search ..... 72/348, 72/336; 413/8; 220/269, 254.1, 619
See application file for complete search history.

(56) References Cited

U.S. PATENT DOCUMENTS 3,186,583 A 6/1965 Zundel
3,525,455 A 8/1970 Saunders
3,696,961 A 10/1972 Holk, Jr.
3,705,563 A 12/1972 Elser
3,765,352 A 10/1973 Schubert et al.
3,848,557 A 11/1974 Holk, Jr.
3,853,080 A 12/1974 Zundel
3,868,919 A 3/1975 Schrecker et al.
3,871,314 A 3/1975 Stargell
3,939,787 A 2/1976 Morrison et al.
3,949,692 A 4/1976 DeLine et al.
3,990,376 A * 11/1976 Schubert et al. ..... 713/13
4,052,949 A * 10/1977 Woodley ..... 413/13
4,511,299 A 4/1985 Zysset
4,516,420 A 5/1985 Bulso, Jr. et al.
4,574,608 A 3/1986 Bulso, Jr. et al.
4,587,825 A 5/1986 Bulso, Jr. et al.
4,587,826 A 5/1986 Bulso, Jr. et al.
4,713,958 A 12/1987 Bulso, Jr. et al.
4,715,208 A 12/1987 Bulso, Jr. et al.

(Continued)

*Primary Examiner*—Dmitry Suhol
(74) *Attorney, Agent, or Firm*—Eric A. Lerner; David P. Maivald; Eckert Seamans Cherin & Mellott, LLC

(57) ABSTRACT

A method and apparatus for forming a rolled reinforcing rib in an end shell of a container body in a single stroke and at a single station of a double action press prior to removal of the shell from the press. A blank disc is cut from sheet material by a punch core advanced by an outer ram. A chuckwall is then formed between a central panel and an outer flange. The central panel is clamped against a die core and a portion of the chuckwall is clamped against a die core ring. An unclamped portion of the chuckwall is located in a void formed between the punch core and die core ring and is rolled into the reinforcing rib upon continued advancement of inner and outer pressure sleeve while maintaining a tight clamping engagement of the central panel and outer flange of the blank disc. Simultaneous removal of the clamping force applied by the punch core and inner and outer pressure sleeves retain the rib in its rolled condition.

23 Claims, 16 Drawing Sheets

U.S. PATENT DOCUMENTS

| | | | | |
|---|---|---|---|---|
| 4,716,755 | A | 1/1988 | Bulso, Jr. et al. | |
| 4,808,052 | A | 2/1989 | Bulso, Jr. et al. | |
| 5,020,955 | A | 6/1991 | Zumsteg | |
| 5,038,956 | A | 8/1991 | Saunders | |
| 5,970,775 | A | 10/1999 | McClung | |
| 6,014,883 | A | 1/2000 | McClung | |
| 6,425,721 | B1 * | 7/2002 | Zysset | 413/8 |
| 6,428,261 | B1 | 8/2002 | Zysset | |
| 6,685,417 | B1 * | 2/2004 | Heinicke et al. | 413/62 |
| 2002/0023474 | A1 * | 2/2002 | McClung | 72/348 |
| 2003/0034346 | A1 | 2/2003 | Turner et al. | |
| 2003/0042258 | A1 | 3/2003 | Turner et al. | |

* cited by examiner

METHOD AND APPARATUS FOR FORMING CONTAINER END SHELLS WITH REINFORCING RIB

BACKGROUND OF THE INVENTION

1. Technical Field

The invention relates to a method and apparatus for forming end shells for metal containers, and particularly to forming end shells having an annular reinforcing rib. Even more particularly, the invention relates to forming the reinforcing rib in the end shell in a single stroke and at a single station of a double action press.

2. Background Information

In the metal container art, containers usually consist of a body formed of lightweight metal, such as aluminum, and a separate end shell for closing the container, also formed of lightweight metal, from strip material. It is desirable in forming the end shell to form a reinforcing rib at the junction of the chuckwall with the central panel of the shell to provide strength and rigidity to the end shell when secured to the container body. Heretofore, these reinforcing ribs were formed as annular grooves in the end panel, examples of which are shown in U.S. Pat. Nos. 4,713,958, 4,715,208, 4,716,755, 4,808,052, 4,587,825, and 4,516,420. Although these types of reinforcing ribs have proven satisfactory, they provide an area in the can end which can collect impurities and other materials. This is especially undesirable when the container has a removable tab which enables the contents to be drank directly from the container.

Another type of reinforcing rib, referred to as a rolled rib or folded rib, has been developed to replace the annular groove reinforcing rib. This reinforcing rib is formed in the metal end shell by collapsing or rolling a portion of an unclamped portion of an end shell chuckwall back upon itself during the formation of the end shell in a single action press. Although this type of rolled or folded reinforcing rib has proven satisfactory, it involves multiple operations and in particular, requires forming the folded rib at a first station or in a first press, and then final forming it in a second station or second press due to the partial unrolling or unfolding of the rolled rib after it has been formed at a first station due to the tendency of the metal in an unclamped portion thereof to return to its pre-stamped position.

Thus, the need exists for an apparatus and method for forming container end shells having a folded or rolled annular reinforcing rib in a single press cycle and at a single station, without having to complete the forming of the rib at a subsequent station, by eliminating the tendency of the stamped end shell including the rolled rib, to return to its pre-stamped condition.

BRIEF SUMMARY OF THE INVENTION

The present invention provides an apparatus and method for forming an end shell for use on a container body which is formed in a single press cycle at a single work station of a double action press, wherein an unclamped portion of the chuckwall of the end shell, which extends between a central panel and peripheral flange, is folded or rolled upon itself to form a rolled reinforcing rib adjacent the junction of the central panel and chuckwall.

Another aspect of the present invention provides for the forming of an annular rolled reinforcing rib in the end shell without complicated and expensive modifications for retrofitting existing double action presses, and which eliminates the need for transfer mechanisms for the transferring of the end shell to an adjacent station or press for final formation of the reinforcing rib in the container end shell.

A further aspect of the invention provides an apparatus and method for forming the reinforcing rib in the end shell in which the punch core is fluidly mounted on an inner ram of the press, enabling the ram to continue in its cycle after the punch core has reached the bottom of its stroke for clamping the central panel of a disc blank against the die core, which enables the inner ram to time its return stroke to correspond to the start of the return stroke of the outer ram.

Another feature of the invention is providing inner and outer pressure sleeves which are movable by the outer ram for clamping engagement with an aligned inner die core ring, wherein said die core ring forms an annular void with the punch core in which the rolled reinforcing flange is formed during continued movement of the inner and outer pressure sleeves after the punch core has bottomed out against the die core.

Still another feature of the invention is to provide the inner pressure sleeve with a curved surface against which an unclamped portion of the chuckwall of the partially formed end shell is engaged for curling or rolling the unclamped metal upon itself to form the rolled reinforcing rib.

A further feature of the invention is to provide for the simultaneous un-clamping of the punch core and inner and outer pressure sleeves from the formed end shell by timing the cyclical movement of the inner and outer rams, to prevent distortion of the formed metal and in particular, prevent partial unrolling of the formed reinforcing rib.

The foregoing advantages, construction, and operation of the present invention will become more readily apparent from the following description and accompanying drawings.

BRIEF DESCRIPTION OF THE DRAWINGS

A preferred embodiment of the invention, illustrative of the best mode in which applicant contemplates applying the principles, is set forth in the following description and is shown in the drawings and is particularly and distinctly pointed out and set forth in the appended claims.

Similar numerals refer to similar parts throughout the drawings.

DETAILED DESCRIPTION OF THE INVENTION

Figure 1:
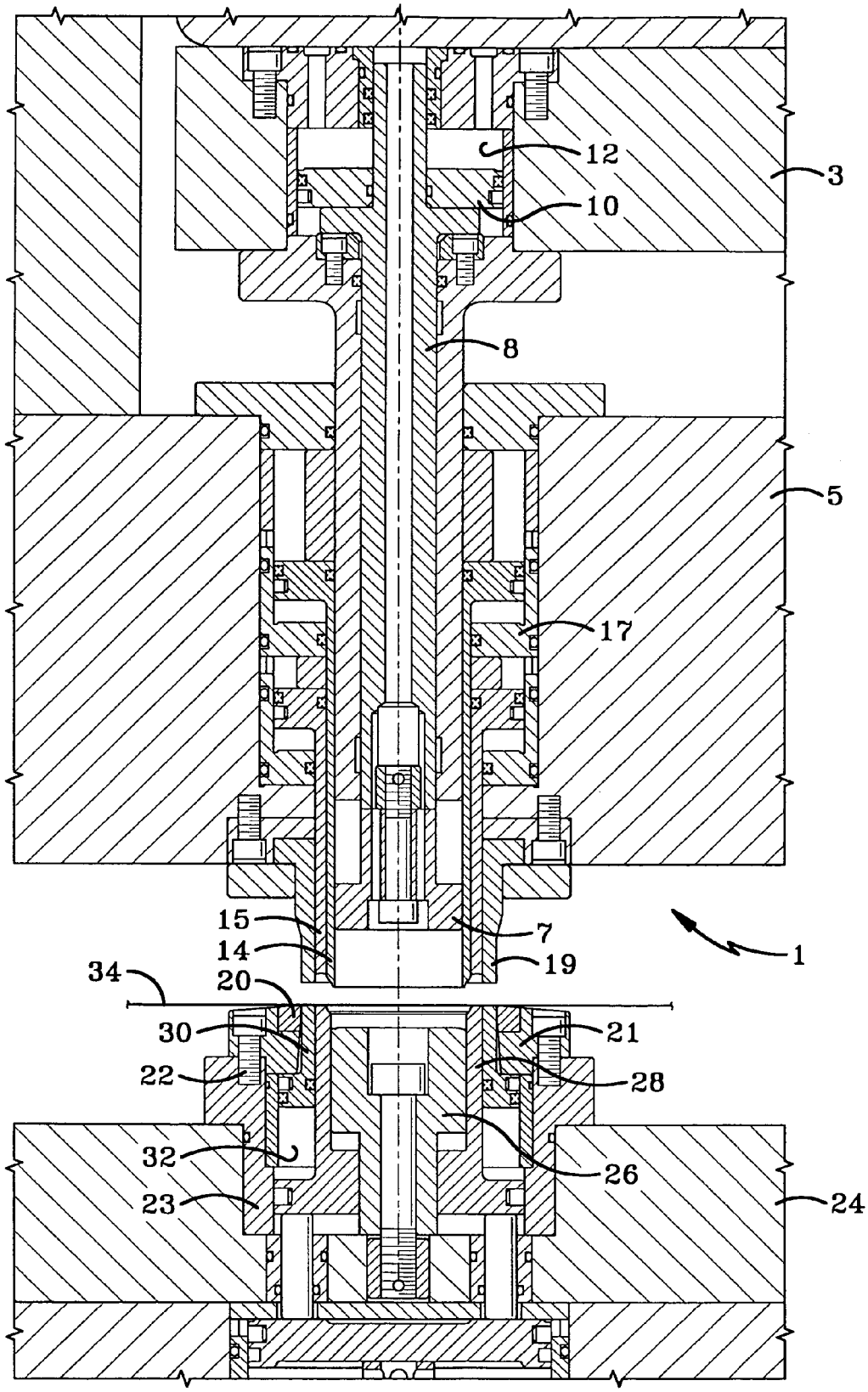
FIG. 1 is a partially schematic sectional view of the apparatus of the present invention mounted in a press showing the position of the sheet metal at the start of the forming operation.

The method and apparatus of the present invention is utilized in conjunction with a double action press, some examples of which are shown and described in U.S. Pat. Nos. 3,902,348, 5,626,048, and 5,628,224. The main features of the press, which is indicated generally at 1 and shown in FIG. 1, are described briefly below, and include an inner ram 3 and an outer ram 5, only portions of which are shown in FIG. 1.

A punch core 7, also referred to as draw horn, is connected to the lower end of a punch riser 8, which is reciprocated by inner ram 3. In accordance with one of the features of the invention as shown in FIG. 1, riser 8 and punch core 7 are engaged with a fluid actuated piston 10, which is moved into engagement with punch riser 8 by compressed fluid located within a cylinder 12 formed within inner ram 3. The purpose of this arrangement is discussed further below.

An inner pressure sleeve 14 and a concentrically located outer pressure sleeve 15 surround punch core 7 and are reciprocated by outer ram 5 and independently move by a plurality of stacked cylinders 17. An outer punch shell 19 surrounds inner and outer pressure sleeves 14 and 15 and is secured to and movable with outer ram 5. A cut ring 20 is mounted on a retaining sleeve 21, which in turn is secured by a plurality of bolts 22 to a pedestal 23 mounted in a base 24.

A die core 26 is fixedly mounted with respect to base 24, and is surrounded by a movable die core ring 28, which is fluidly supported with respect to base 24. A lower pressure sleeve 30 is concentrically located outboard of die core ring 28, and is fluidly supported within a pressure cylinder 32 with respect to base 24.

The particular arrangement and features of the various elements of press 1 set forth above are standard components in the container end shell forming art, and thus, do not require extensive modification except for several unique features discussed further below.

Figure 2:
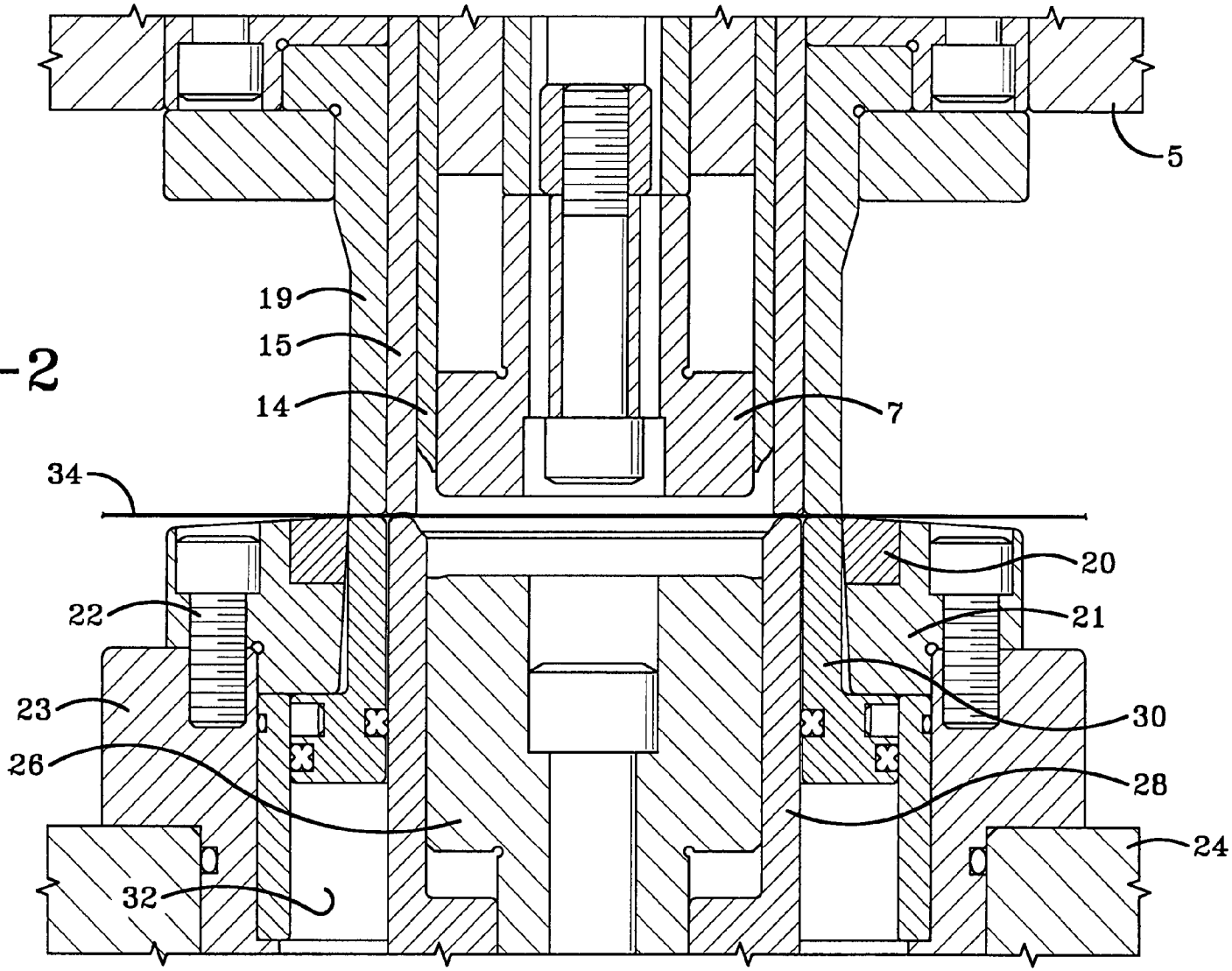
FIG. 2 is an enlarged view showing the position of the apparatus at the start of the forming operation.
Figure 3:
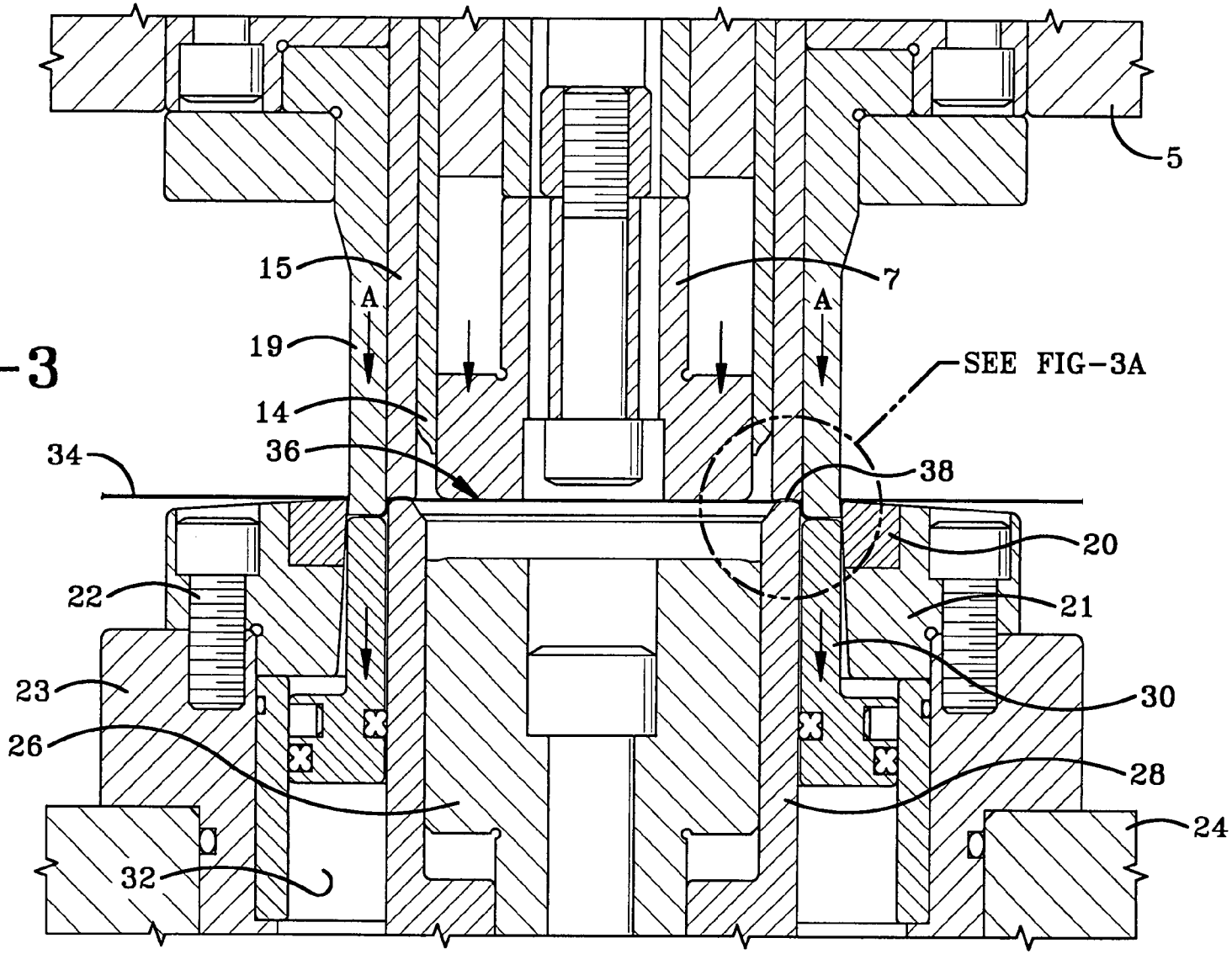
FIG. 3 is an enlarged fragmentary sectional view similar to FIG. 1 showing the blanking of a disc blank from the sheet material at the start of the forming operation.

In further accordance with the invention, a timing mechanism represented by the timing diagram of FIG. 7, controls the reciprocal movement or strokes of inner and outer rams 3 and 5 in a manner well known in the press art, and thus, is not described in detail except for the unique features of the timing cycle discussed further below achieved by the timing control system. In carrying out the method steps of the present invention, a strip of sheet material 34, such as lightweight aluminum, is fed into the press, as shown in FIGS. 1 and 2. Outer ram 5 moves punch shell 19 downwardly in the direction of arrow A (FIG. 3) to sever a flat blank disc 36 from the sheet material without requiring any prior clamping pressure being applied to the sheet material. Blank 36 then is releasably clamped between outer pressure sleeve 15 and top surface 38 of die core ring 28.

Figure 3A:
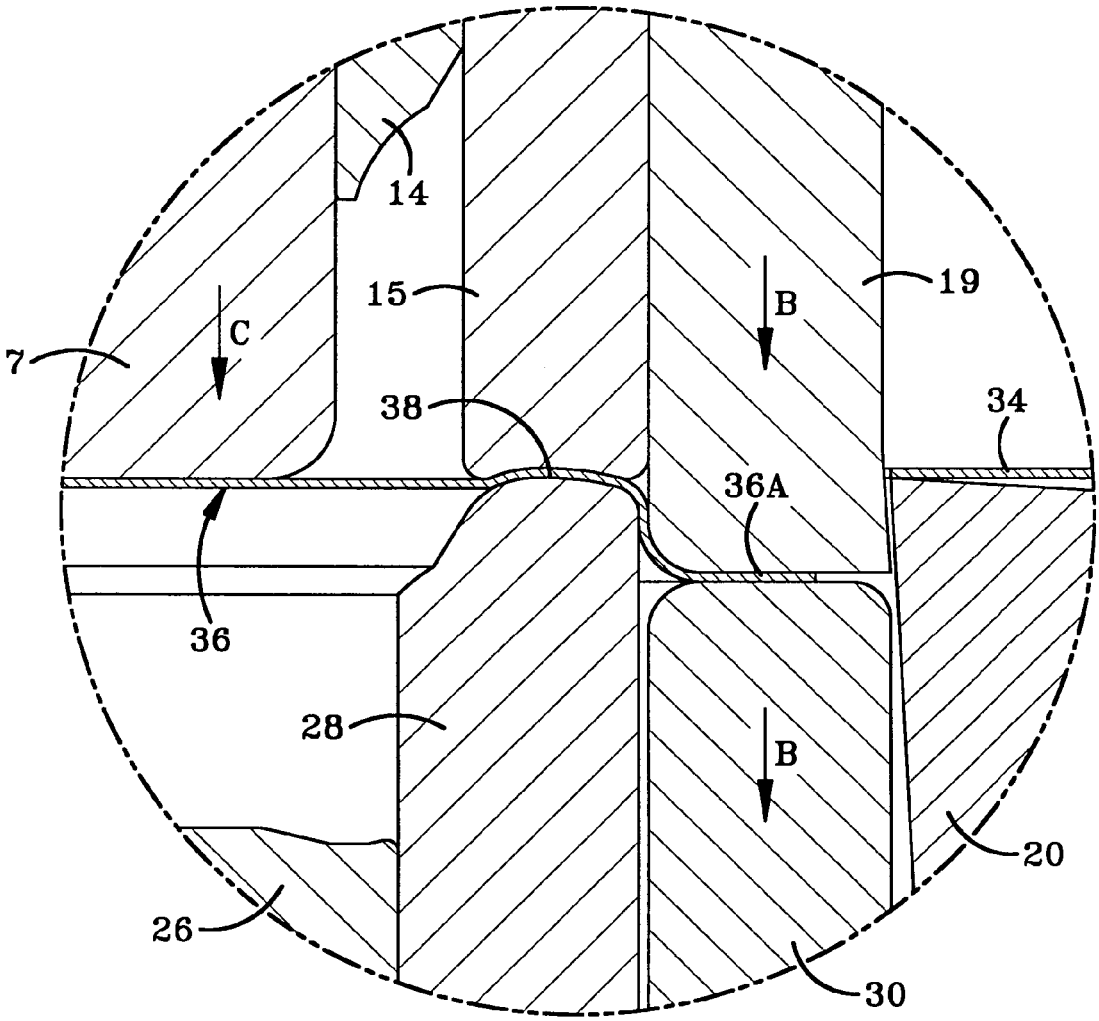
FIG. 3A is a further enlarged fragmentary sectional view of the encircled portion of FIG. 3.
Figure 3B:
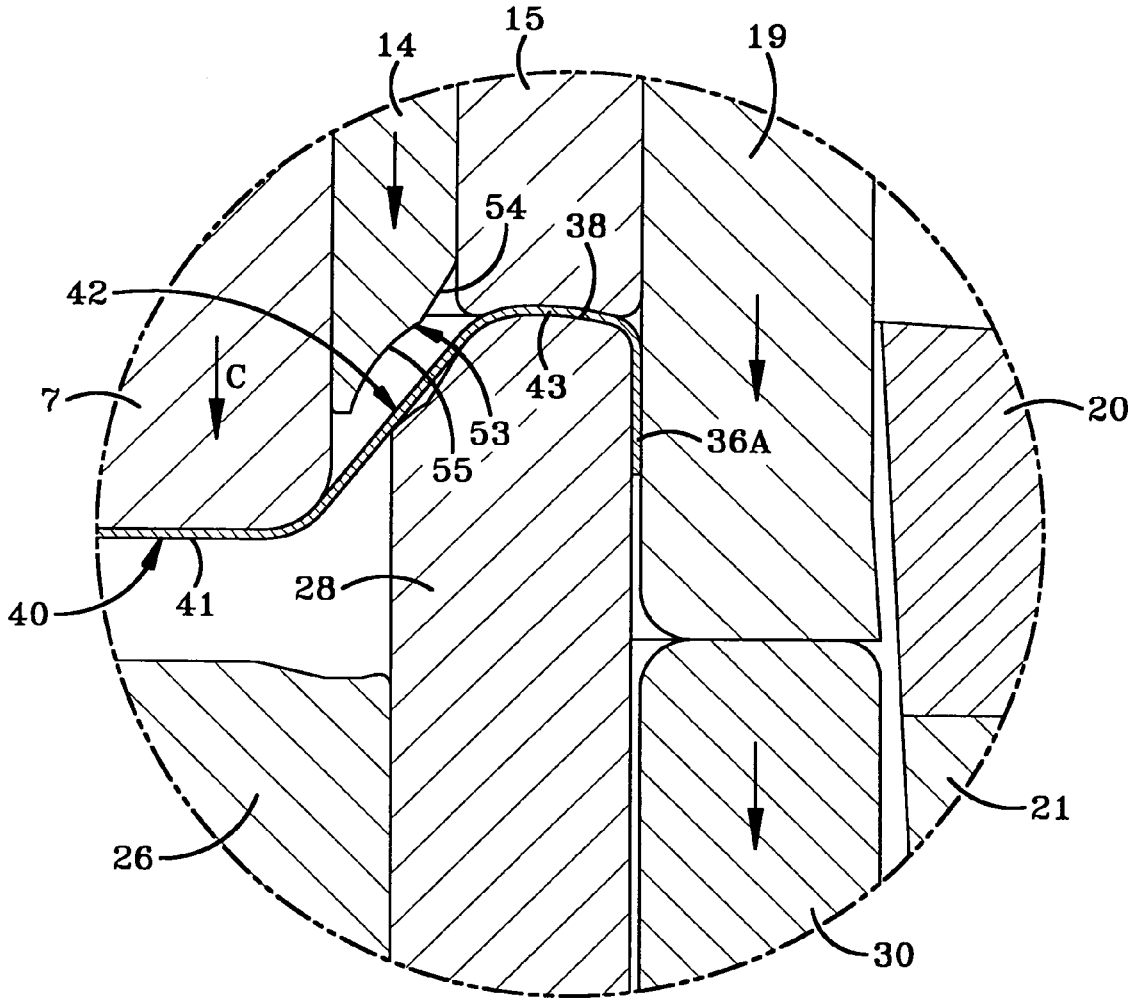
FIG. 3B is a view similar to FIG. 3A showing the start of forming a chuckwall of an end shell blank.
Figure 4:
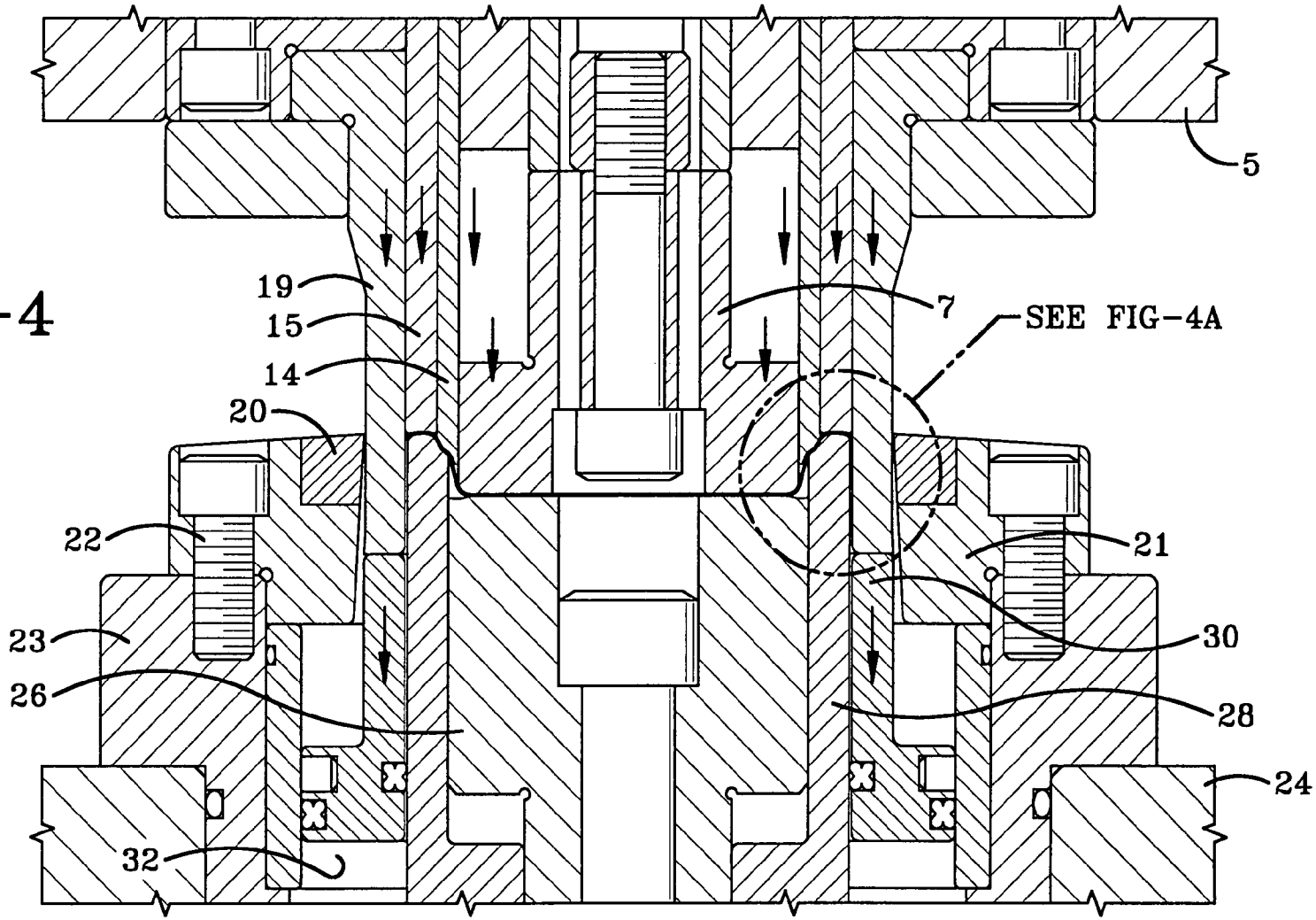
FIG. 4 is a sectional view showing the continued movement of the punch core and inner pressure sleeve from the position of FIG. 3 into clamping engagement with the end shell.
Figure 4A:
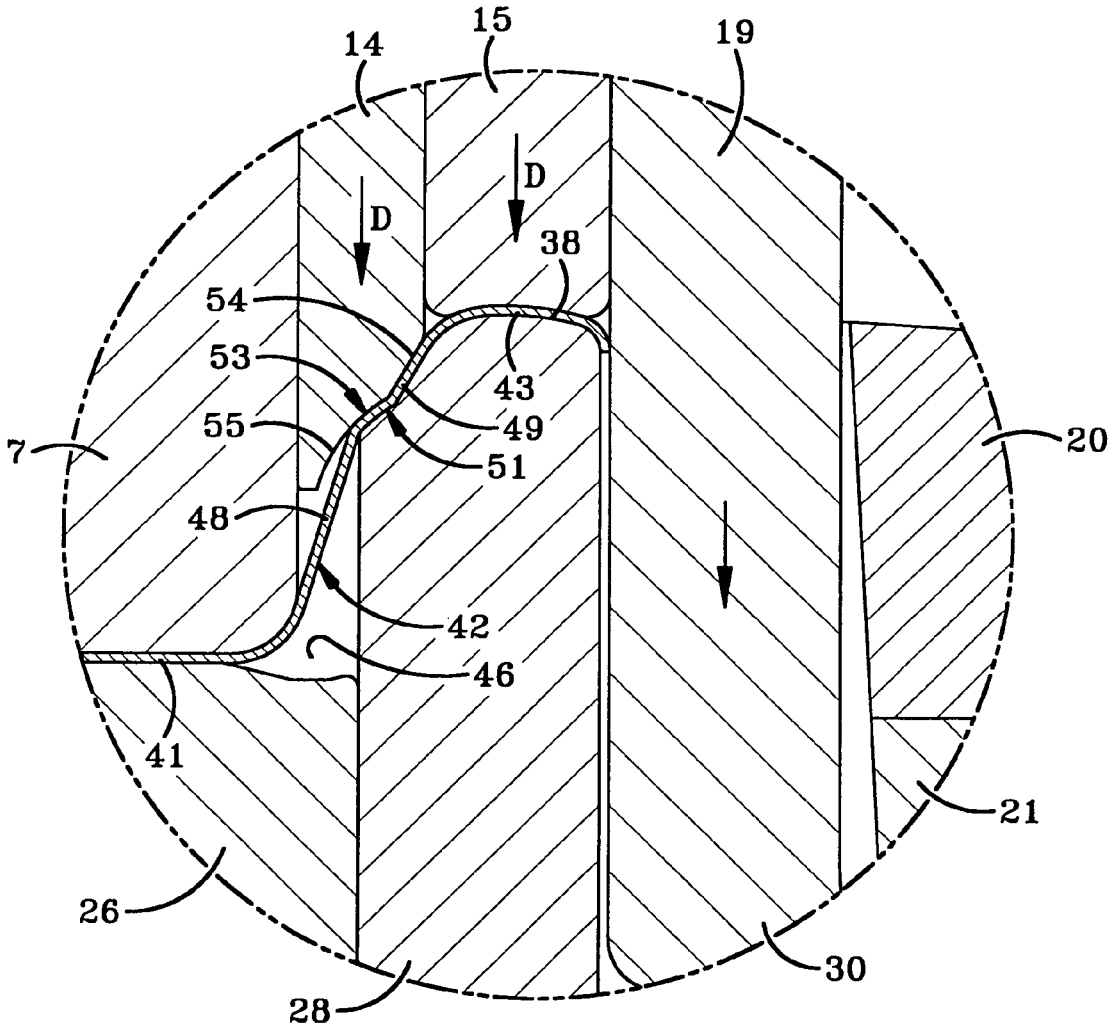
FIG. 4A is a further enlarged fragmentary sectional view of the encircled portion of FIG. 4.

As punch shell 19 and lower pressure sleeve 30 continue to be moved downwardly by outer ram 5 from the position of FIG. 3A to that of 3B in the direction of arrows B, an outer portion 36A of blank disc 36 is releasably clamped therebetween and will subsequently be removed therefrom, as shown in FIG. 3B. Continued downward movement of inner ram 3 will move punch core 7 in a downward direction shown by Arrow C in FIGS. 3A and 3B. As punch core 7 moves toward die core 26, the metal in outer portion 36A of the disc blank, which is releasably clamped between outer pressure sleeve 15 and die core ring 28, moves therebetween to form a partially formed end shell 40. Shell 40 has a central panel 41, a chuckwall 42, and an outer flange 43. Inner ram 3 continues to advance punch core 7 toward base 24 by the use of the high pressure air in cylinder 12 as shown in FIG. 1, until it clamps central panel 41 against die core 26, as shown in FIG. 4A. In this position, outer flange 43 is clamped between outer pressure sleeve 15 and complementary shaped top surface 38 of die core ring 28.

Figure 3C:
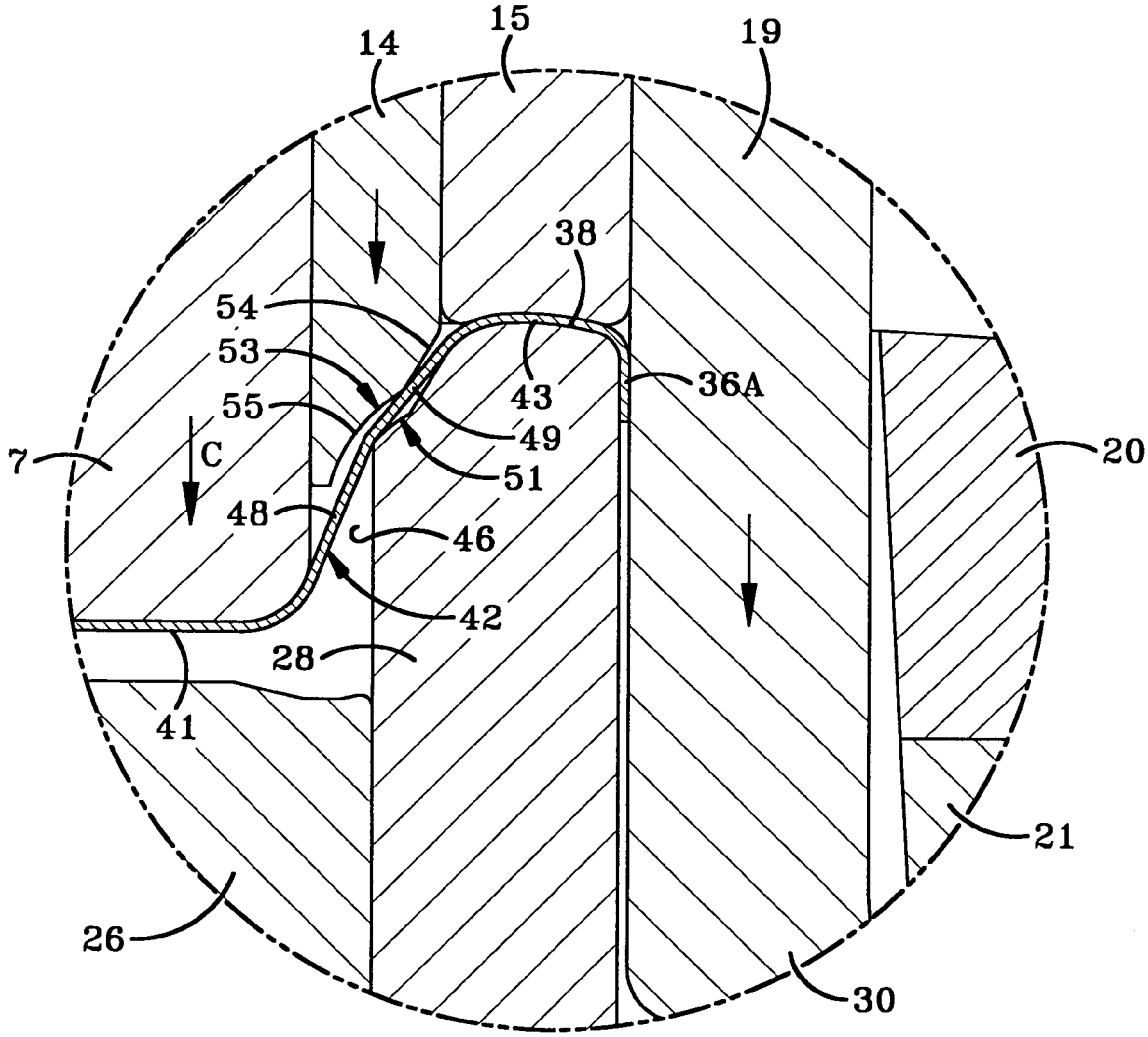
FIG. 3C is a view similar to FIGS. 3A and 3B showing the continued formation of the chuckwall of the end shell blank.

As shown in FIGS. 3C and 4A, an annular void or space 46 is formed between punch core 7 and die core ring 28 in which is located an unclamped portion 48 of chuckwall 42. As outer ram 5 continues downwardly, inner pressure sleeve 14 (FIG. 3A) will clampingly engage a chuckwall portion 49 against an angled surface 51 of the upper end of die core ring 28 adjacent the smooth generally curved surface 38 thereof. The lower end of inner pressure sleeve 14 (FIG. 3C) has a contoured surface indicated generally at 53, having an angled portion 54 and a concavely curved portion 55. Punch core 7 will bottom out and clamp central panel 41 of shell 40 against the top surface of die core 26 (FIG. 4A) and inner and outer pressure sleeves 14 and 15 continue to advance as shown by arrows D.

Figure 4B:
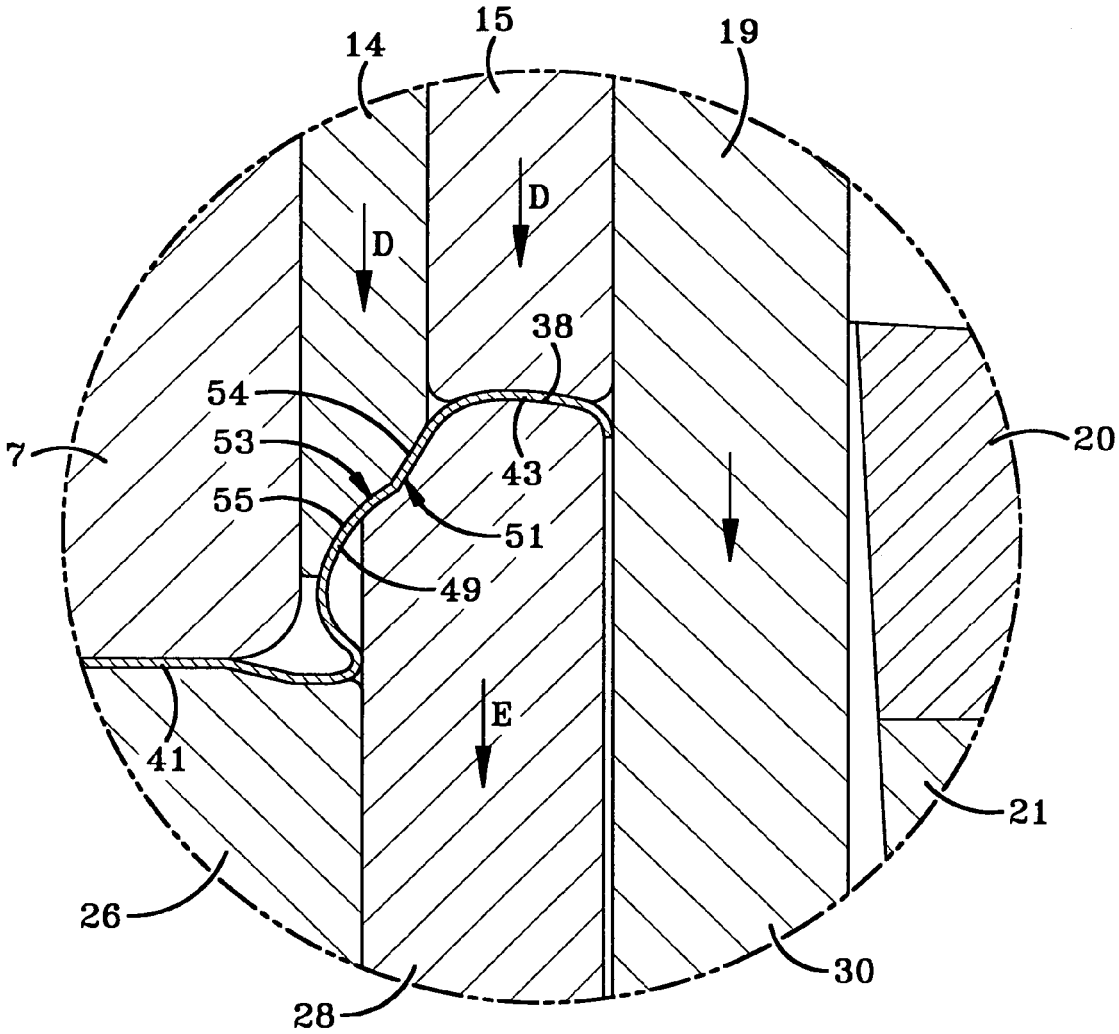
FIG. 4B is a view similar to FIG. 4A showing the continued movement of the inner and outer pressure sleeves to start the folding of the un-clamped chuckwall portion into the reinforcing rib.
Figure 5:
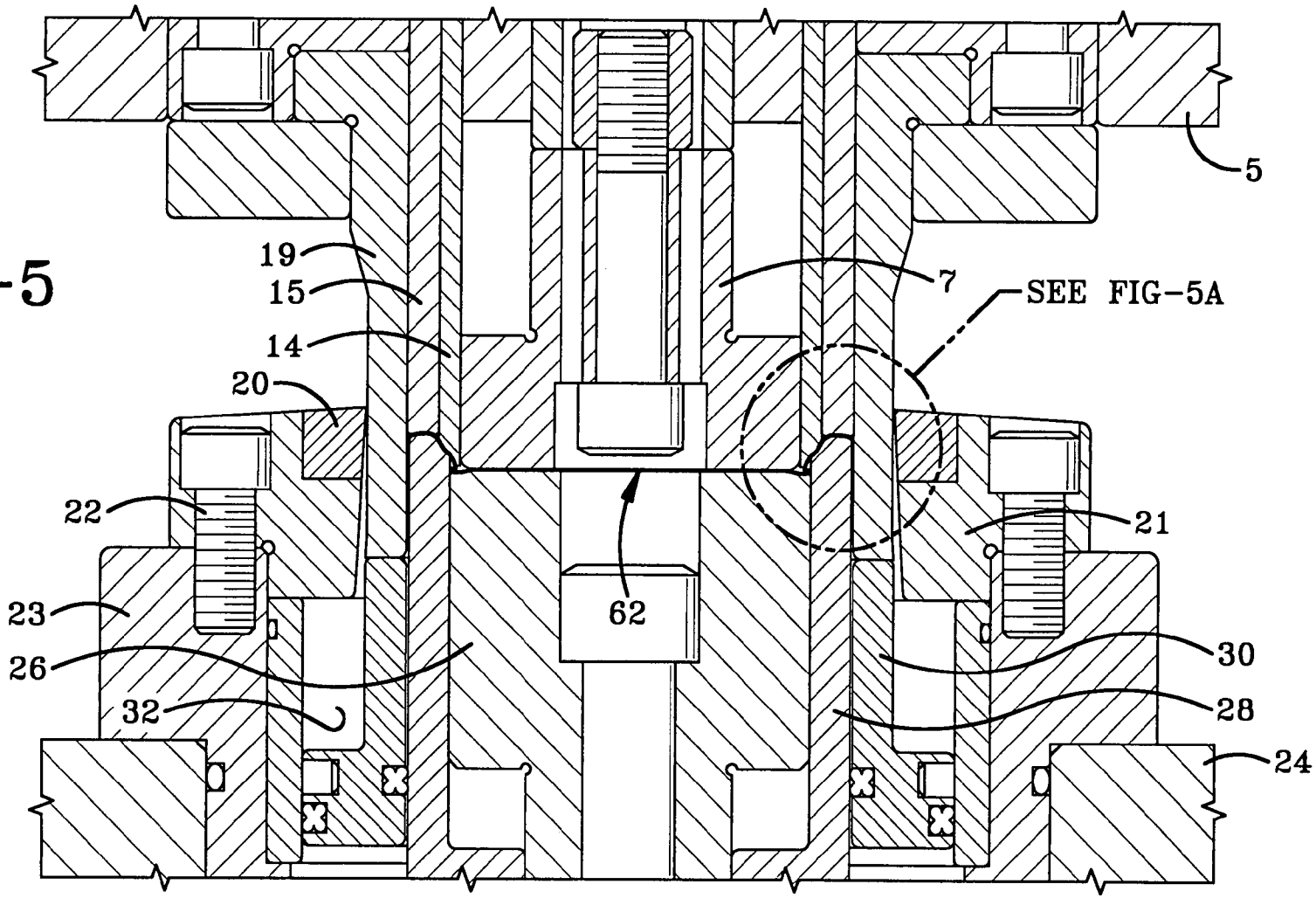
FIG. 5 is a view similar to FIGS. 3 and 4 showing the punch core, and inner and outer rams at the end of their stroke completing formation of the reinforcing rib.
Figure 5A:
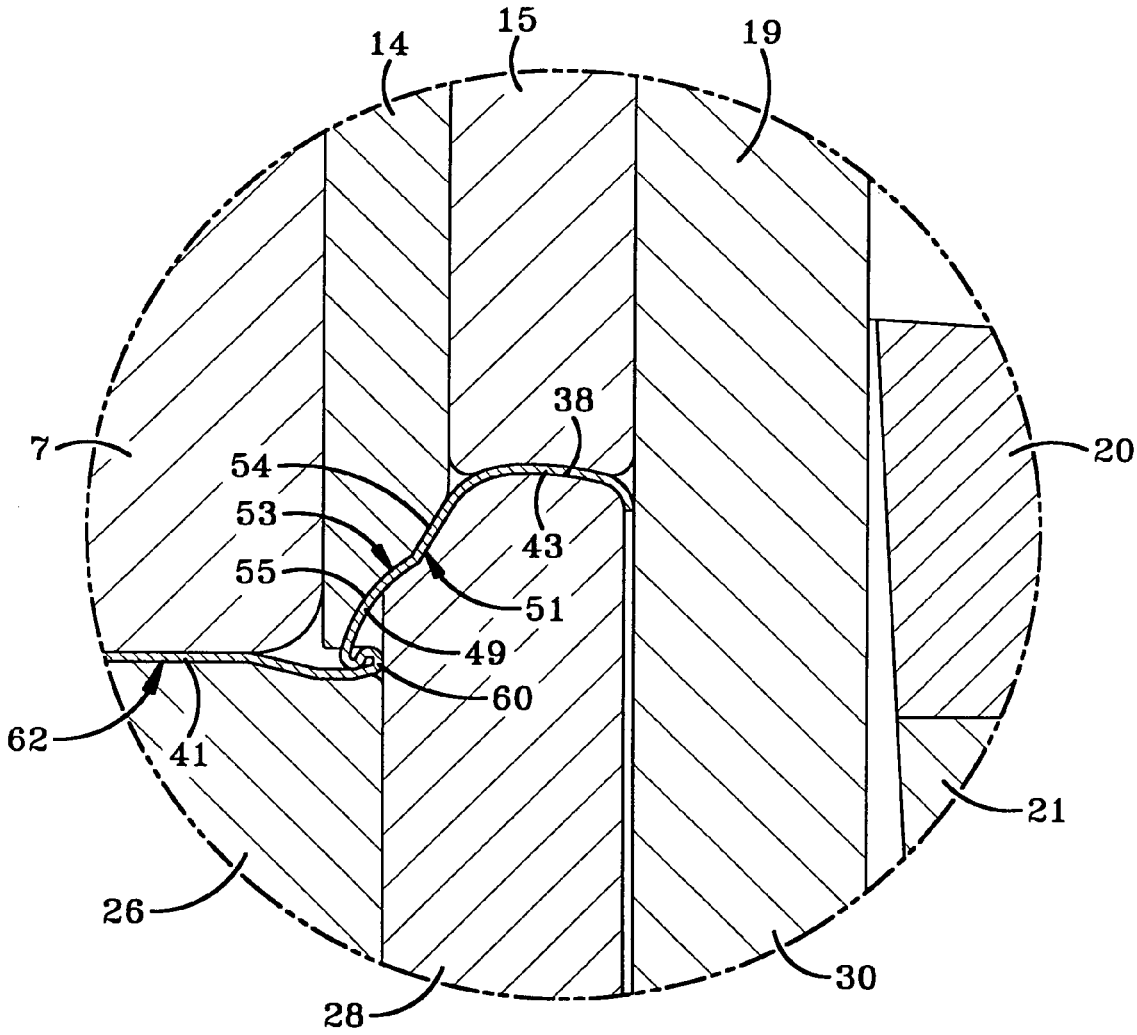
FIG. 5A is an enlarged fragmentary sectional view of the encircled portion of FIG. 5 showing the apparatus and end shell at the completion of the forming step.

Referring to FIG. 4B the continued downward movement of outer ram, and in particular, inner and outer pressure sleeves 14 and 15 in the direction of arrows D, moving with it the fluidly supported die core ring 28, as shown by arrow E, will cause the unclamped portion 48 of chuckwall 42, which is located in annular space 46, to move against concave surface portion 55 of inner pressure sleeve 14, causing the metal to start folding upon itself until it is completely rolled or folded on itself to form a reinforced rolled rib 60, as shown in FIG. 5A, upon pressure sleeves 14 and 15 reaching bottom-dead-center, as shown therein. During this movement, panel 41 is clamped tightly against die core 26 and portion 49 of chuckwall 42 is clamped tightly between inner pressure sleeve 14 and surface 51 of die core ring 28.

Figure 5B:
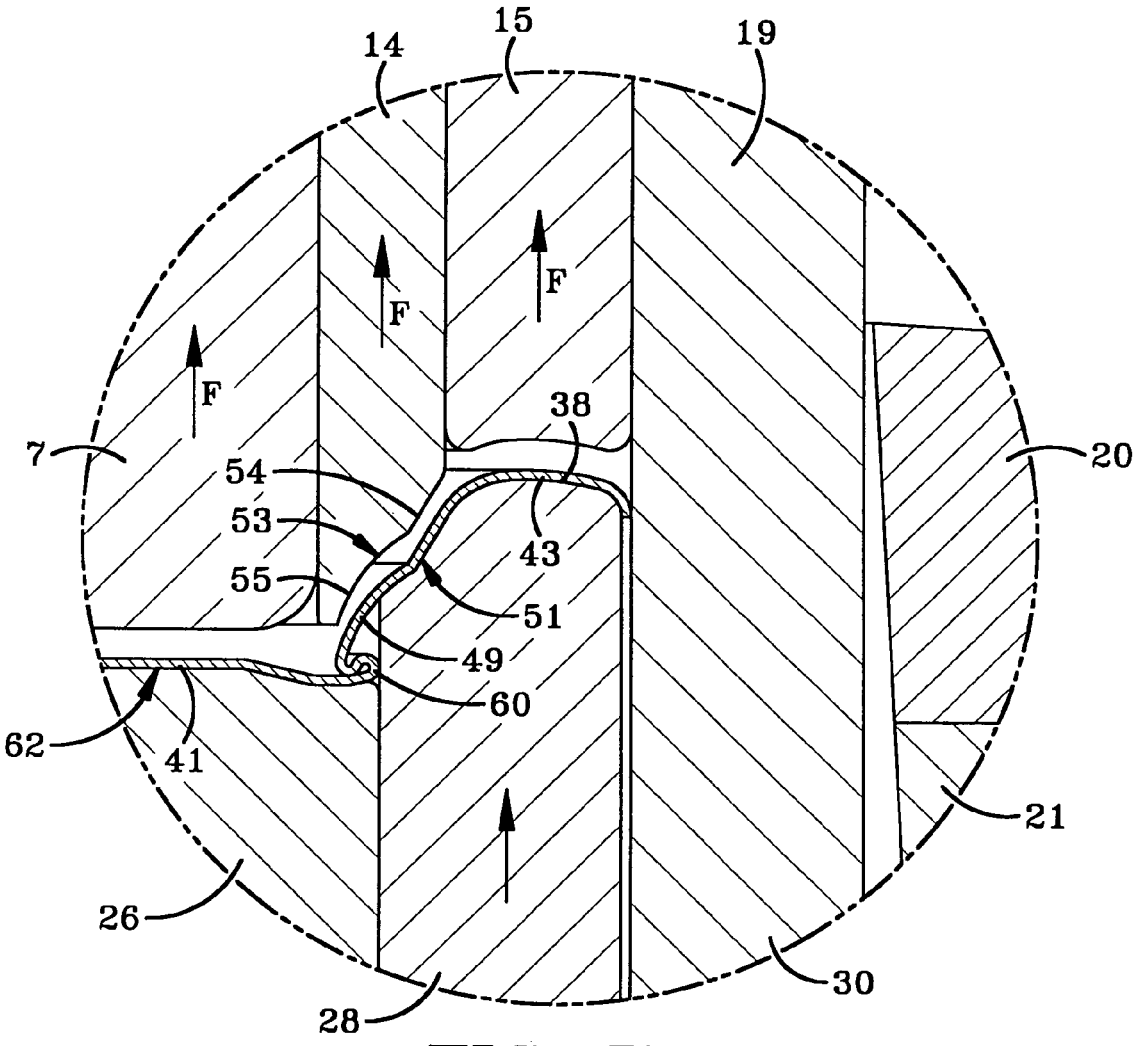
FIG. 5B is a view similar to FIG. 5A showing the simultaneous disengagement of the punch core and inner and outer pressure sleeves from the formed container end shell.

In accordance with one of the main features of the invention, the timing cycle of the inner and outer rams is controlled so that punch core 7, and inner and outer sleeves 14 and 15, retract or move away from their clampingly engaged position with die core 26 and die core ring 28 substantially simultaneously, as shown by arrows F in FIG. 5B. This prevents unequal metal distortion from being exerted on the formed end shell which is indicated generally at 62, and in particular on rib 60, which occurred in prior shell forming methods in which a rolled reinforcing rib was formed. Heretofore, in single action presses, the pressure sleeve would lift off before punch core 7, or visa versa, resulting in a partial unfolding of the rolled rib, which required the shell to be moved to a second station, either in the same press or in a different press, for final setting or formation of the rolled rib.

Figure 6:
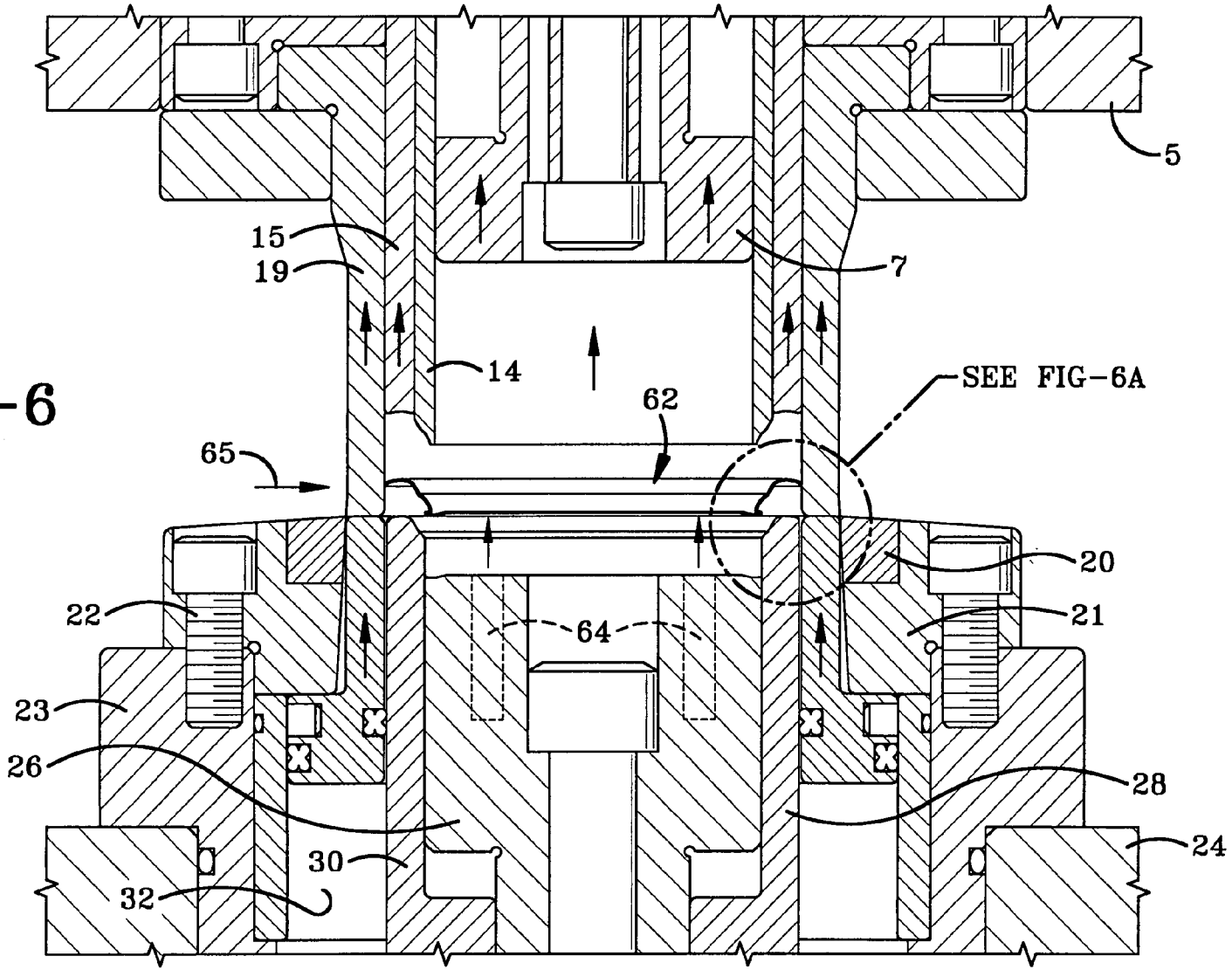
FIG. 6 is a view similar to FIGS. 3, 4, and 5 showing movement of the inner and outer rams and the position of the finished end shell prior to removal from the press.
Figure 6A:
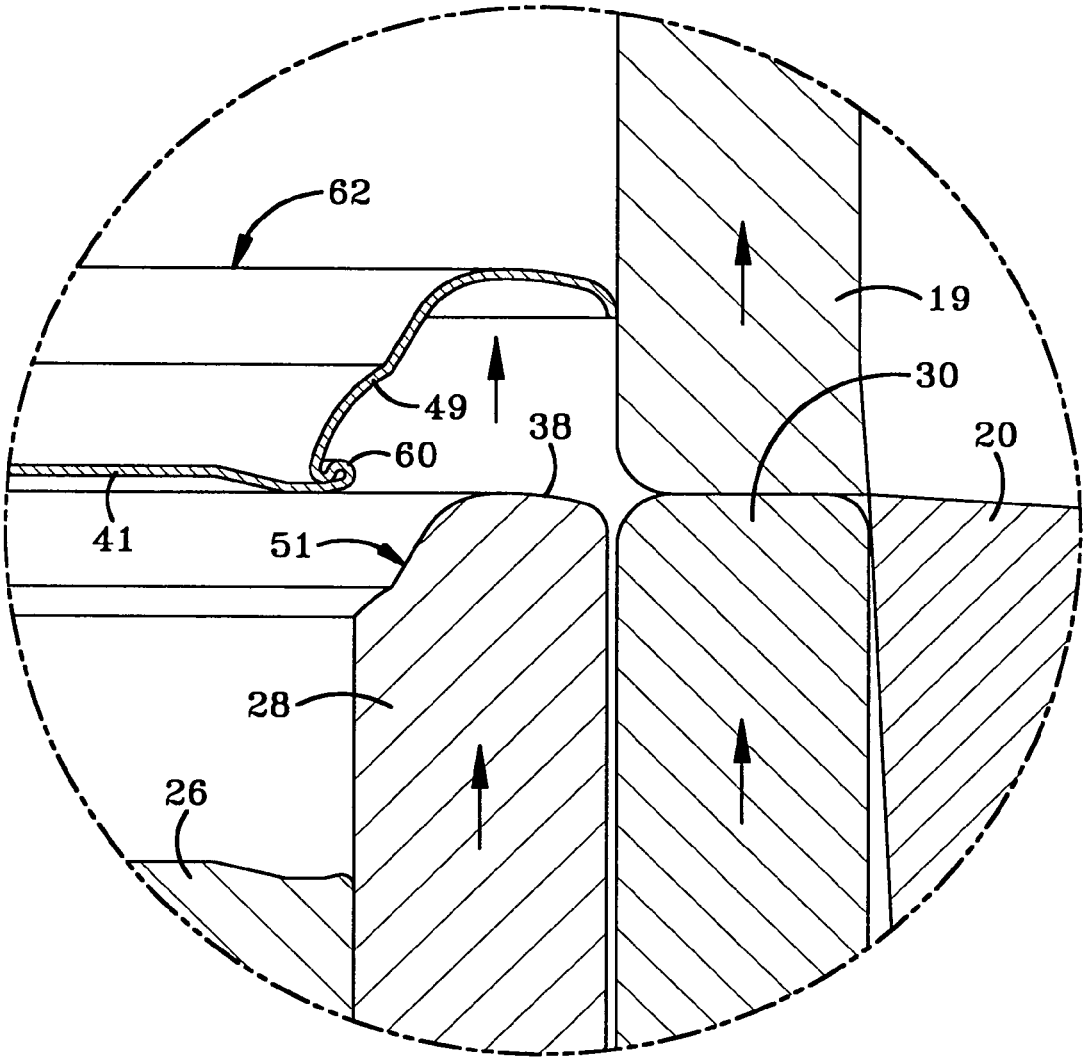
FIG. 6A is an enlarged fragmentary sectional view of the encircled portion of FIG. 6.
Figure 8:
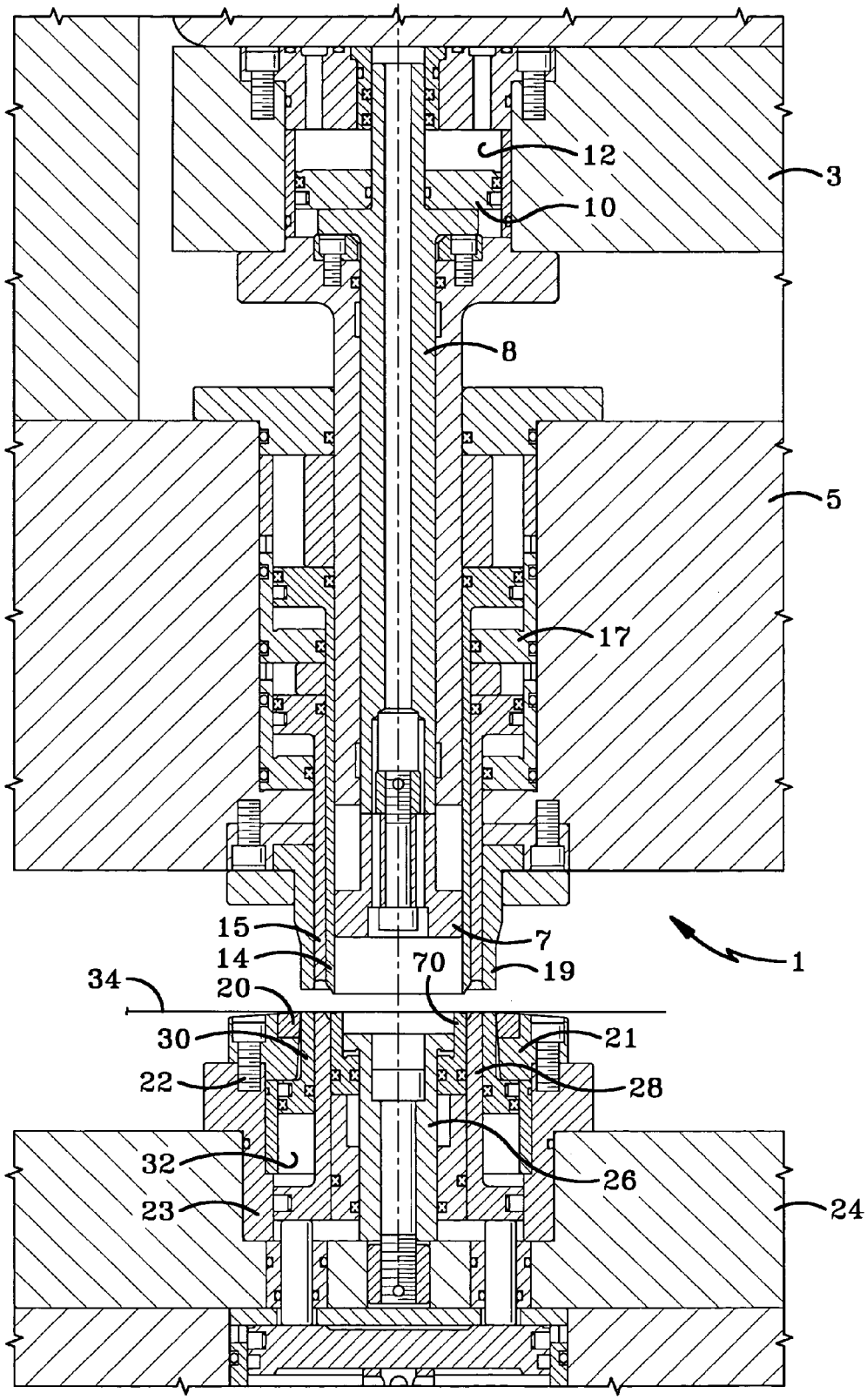
FIG. 8 is a fragmentary sectional view similar to FIG. 1 showing a knockout ring to assist in ejecting the end shell from the press.

However, it has been found that in accordance with the invention, the simultaneous removal of nearly all clamping pressure during lift off, as shown in FIG. 5B, prevents partial unrolling of the just formed reinforcing rib 60 since even though the metal attempts to return to an unformed state, it moves equally in all directions since it is unrestrained by any clamping action thereon. If desired, punch core 7 could retract slightly before pressure sleeves 14 and 15 without substantially effecting the final set or formation of rib 60. After release and retraction of punch core 7 and inner and outer pressure sleeves 14 and 15, shell 62 is released from the press by a blast of pressurized air though passages 64 formed in base 24 (FIG. 6), or other lift mechanism, such as an annular lift or knockout ring 70 as shown in FIG. 8, to the position of FIG. 6A, where it then can be ejected from the press by a jet of pressurized air 65, or other known ejection mechanism or device.

Figure 7:
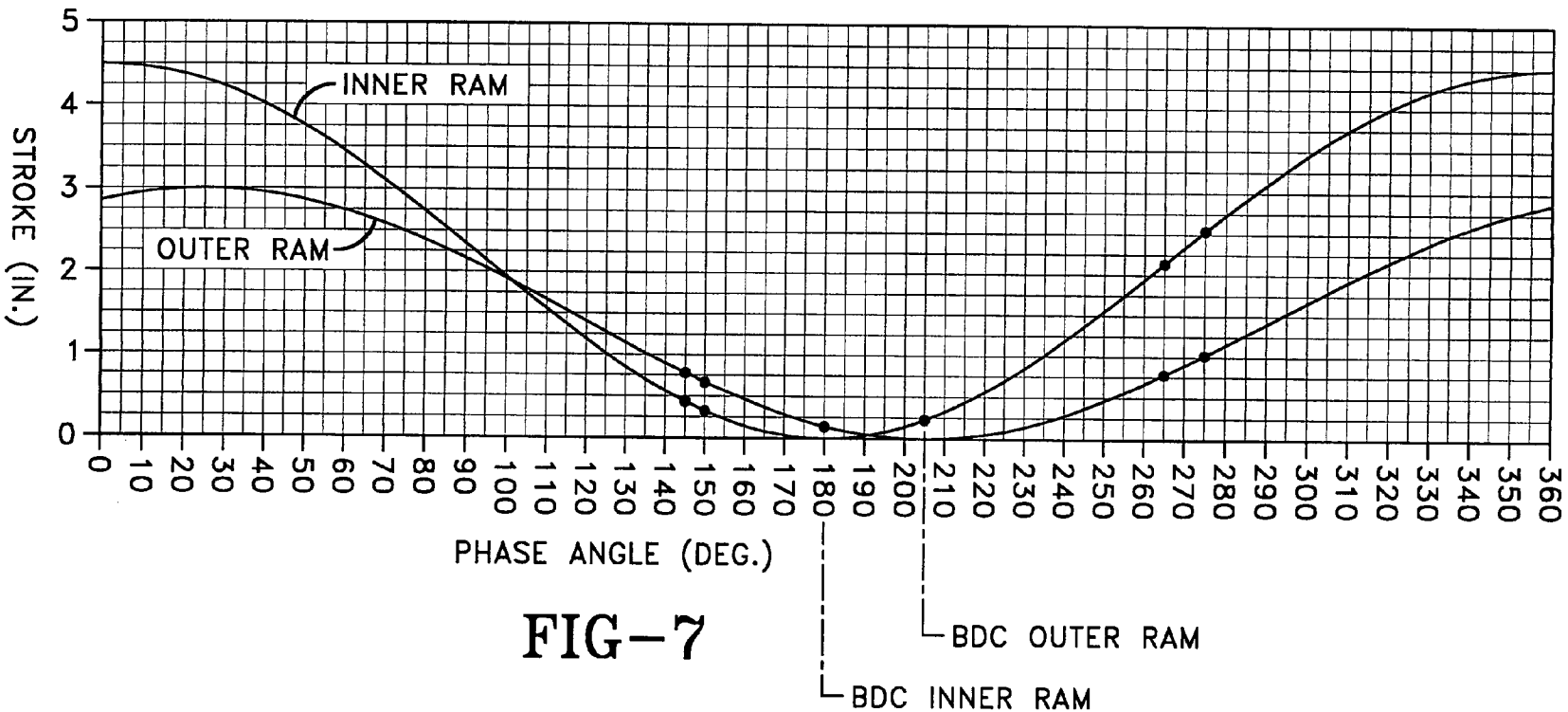
FIG. 7 is a timing diagram of the inner and outer rams of the press.

In accordance with one of the features of the invention, and as represented in FIG. 7, is the timing sequence of the inner and outer rams. The inner ram leads the outer ram approximately 25° so that the inner ram clamps the central panel against the die core, as shown in FIG. 4A, as it reaches bottom-dead-center (BDC), whereupon the outer ram continues to move pressure sleeves 14 and 15 in a downward direction to form rolled rib 60 in the annular space 46, as shown in FIG. 4B. This movement is able to be achieved by the use of piston 10 and fluid cylinder 12, as shown in FIG. 1. This arrangement enables the punch core 7 to be moved initially along with inner ram 3, but upon punch core 7 reaching bottom-dead-center as shown in FIG. 4, this fluid pressure arrangement provides for a dwell time of approximately 25° movement of the outer ram since inner ram 3 will continue its downward movement. However, punch core 7 remains stationary, with piston 10 moving upwardly through cylinder 12. This travel of piston 10 within cylinder 12 enables the inner ram to continue to move, but without affecting the clamping engagement of central panel 41 against die core 26. Therefore, as the outer ram reaches its bottom-dead-center, for example, 205° as shown in FIG. 7, inner ram 3 will still be at its bottom-dead-center, whereupon both the inner and outer rams will move upwardly at approximately the same instant of time to simultaneously remove the clamping engagement with the newly formed end shell, as shown in FIG. 5B, avoiding the partial unrolling of reinforcing rib 60. In the prior art formation of a rolled reinforcing rib in a single stage press, one of the pressure members will retract before the die core or visa versa resulting in one part of the shell remaining clamped, while the clamping pressure on another portion is relieved resulting in the partial unfolding of the rolled reinforcing rib.

The particular timing mechanism used for such presses is standard, and is easily calibrated to provide for any desired sequence of movement of the inner and outer ram, and thus, is not described in detail since the same is well known in the press art.

It furthermore understood from the above discussion that no thinning of the metal is required, but only the drawing and movement of the metal around the die core ring and a portion of the unclamped chuckwall back upon itself to form the final end shell with the rolled reinforcement rib.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of forming an annular rolled reinforcing rib between a central panel and a chuckwall of an end shell in a single stroke and at a single station of a double action press prior to the removal of the shell from the press, comprising the steps of:

blanking and drawing a disc blank having a central panel and an outer flange by wiping the periphery of the disc blank over an inner die core ring;

forming a chuckwall by advancing a punch core and clamping a portion of the central panel against a die core;

clamping a portion of the chuckwall between an inner pressure sleeve and the die core ring;

providing an annular void between the punch core and die core ring when the punch core clamps the central panel against the die core;

forming the rolled reinforcing rib from an unclamped portion of the chuckwall within the annular void by advancing the inner and outer pressure sleeves while maintaining clamping engagement of the central panel between the punch core and die core, and between the inner pressure sleeve and die core ring; and releasing said clamping engagement substantially simultaneously between the punch core and die core and between the inner pressure sleeve and die core ring after forming the reinforcing rib.

2. The method defined in claim 1 including the steps of:

providing an inner ram;

mounting the punch core on the inner ram;

applying a fluid pressure to the punch core for clamping the central panel between the punch core and die core; and continuing to advance the inner ram after the die core has clamped the central panel between the punch core and die core by overcoming said fluid pressure to provide a dwell time for said punch core in clamping engagement with said central panel.

3. The method defined in claim 2 including the step of:

providing the dwell time for approximately 25° of the inner ram movement.

4. The method defined in claim 3 including the steps of:

providing an outer ram;

mounting the inner and outer pressure sleeves on the outer ram; and moving the inner ram in advance of the outer ram for clamping the central panel and chuckwall before forming the rolled reinforcing rib.

5. The method defined in claim 1 including the step of mounting the die core in a fixed position of the base.

6. The method defined in claim 1 including the step of providing the inner pressure sleeve with a contoured end having an angled surface portion and a concave surface portion.

7. The method defined in claim 1 including the step of reaching bottom-dead-center of the inner ram stroke approximately 25° before reaching bottom-dead-center of the outer ram stroke.

8. The method defined in claim 1 including the step of discharging the shell from the press by applying a jet of pressurized air against said shell.

9. A method of forming an annular rolled reinforcing rib between a central panel and a chuckwall of an end shell in a single stroke and at a single station of a double action press prior to the removal of the shell from the press, comprising the steps of:

blanking and drawing a disc blank having a central panel and an outer flange;

forming an elongated chuckwall between the central panel and outer flange;

clamping the central panel against a die core;

clamping a portion of the chuckwall between a pressure sleeve and a die core ring;

providing an annular void between the punch core and a die core ring when a punch core clamps the central panel against the die core;

forming the rolled reinforcing rib from an unclamped portion of the chuckwall within the annular void by advancing the pressure sleeve while maintaining clamping engagement of the central panel between the punch core and die core, and between the pressure sleeve and die core ring; and releasing said clamping engagement substantially simultaneously between the punch core and die core and between the pressure sleeve and die core ring after forming the reinforcing rib.

10. The method defined in claim 9 including the steps of providing inner and outer rams;

advancing the inner ram to clamp the control panel against the die core;

advancing the outer ram to clamp the outer flange between the pressure sleeve and die core ring;

reaching a bottom-dead-center position in the stroke of inner ram before forming the rolled reinforcing rib upon advancement of the outer ram to a bottom-dead-center position; and maintaining the inner ram at its bottom-dead-center position while said outer ram moves to its bottom-dead-center position.

11. In a double action press having inner and outer rams and an opposed base and apparatus for forming an end shell of a container from a sheet metal blank, wherein the end shell has a rolled annular reinforcing rib, said apparatus comprising:

a) a punch core carried by the inner ram and a die core mounted on the base in opposed relationship therewith;

b) inner and outer pressure sleeves carried by the outer ram and a movable die core ring carried by the base in opposed relationship therewith;

c) said outer pressure sleeve releasably holding an outer flange of the blank against the die core ring as the die core draws material over the die core ring to form a chuckwall extending between said outer flange and a central panel;

d) said inner pressure sleeve being movable into clamping engagement with and holding a portion of the chuckwall adjacent the outer flange against the die core ring leaving an unclamped portion of the chuckwall extending between the central panel and clamped portion of said chuckwall;

e) said inner and outer pressure sleeves being movable toward the base while maintaining clamping engagement of the chuckwall and the outer flange against the inner die core ring to roll the unclamped portion of the chuckwall into the rolled reinforcing rib; and f) said punch core and inner and outer pressure sleeves being simultaneously movably out of clamping engagement with the central panel, chuckwall, and outer flange to retain the shape of the rolled reinforcing rib.

12. The apparatus defined in claim 11 including:

a timing control for moving the punch core into clamping engagement with the central panel prior to moving the pressure sleeves into clamping engagement with the chuckwall and outer flange.

13. The apparatus defined in claim 12 including a punch core riser attached to the punch core;

a fluid pressure cylinder mounted on the inner ram; and a fluid actuated piston located within the cylinder and operatively connected to the punch core riser for controlling movement of the punch core until the inner ram reaches a bottom-dead-center position.

14. The apparatus defined in claim 11 including a punch shell carried by the outer ram.

15. Apparatus for forming a container end panel having a central panel, an outer flange and chuckwall, and a rolled reinforcement rib interconnecting said chuckwall and central panel, comprising:

a punch core;

inner and outer pressure sleeves disposed in concentric relationship with said punch core;

a punch shell disposed in concentric relationship with said inner and outer pressure sleeves;

a die core disposed in opposed relationship with said punch core;

a movable die core ring disposed in opposed relationship with said inner and outer pressure sleeves;

a lower pressure sleeve in opposed relationship with said punch shell; and a timing control which simultaneously retracts said punch core and said inner and outer pressure sleeves with respect to said punch core and die core ring after said punch core and said inner and outer pressure sleeves have reached a bottom-dead-center position.

16. The apparatus defined in claim 15 including inner and outer rams, said punch core being carried by the inner ram, and said inner and outer pressure sleeves and punch shell being carried by the outer ram.

17. The apparatus defined in claim 16 wherein the punch core is fluidly supported on the inner ram.

18. The apparatus defined in claim 16 wherein the timing control controls the stroke of the inner and outer rams; and in which the inner ram leads the outer ram.

19. The apparatus defined in claim 18 wherein the inner ram leads the outer ram by a phase angle of approximately 25°.

20. The apparatus defined in claim 15 wherein the die core ring is radially spaced from the punch core when said punch core extends into said die core ring.

21. The apparatus defined in claim 20 wherein the die core ring has a profiled end with a convexly curved outer end surface and an angled surface; in which the outer pressure ring has an end surface complementary to said convexly curved surface and is in opposed relationship therewith; and in which the inner pressure sleeve has an angled end surface complementary to and in opposed relationship to the angled surface of said die core ring.

22. The apparatus defined in claim 21 wherein the inner pressure sleeve has a curved surface adjacent the angled surface thereof; and in which said curved surface extends into the spaced formed between the punch core and die core ring.

23. The apparatus defined in claim 15 wherein the die core is fixedly mounted on a base.

* * * * *